United States Patent [19]

Tanigawa

[11] 3,978,476

[45] Aug. 31, 1976

[54] CIRCUIT CONDUCTION TEST ARRANGEMENT FOR EMERGENCY ALARM SYSTEMS

[75] Inventor: Takeshi Tanigawa, Machida, Japan

[73] Assignee: Hochiki Corporation, Tokyo, Japan

[22] Filed: Dec. 13, 1974

[21] Appl. No.: 532,484

[30] Foreign Application Priority Data

| | | |
|---|---|---|
| Dec. 17, 1973 | Japan | 48-139611 |
| Dec. 17, 1973 | Japan | 48-139612 |
| Dec. 17, 1973 | Japan | 48-139613 |

[52] U.S. Cl. ..... 340/410; 340/412

[51] Int. Cl.[2] ..... G08B 29/00

[58] Field of Search ..... 340/214, 409, 412, 410

[56] References Cited

UNITED STATES PATENTS

| | | | |
|---|---|---|---|
| 3,094,690 | 6/1963 | Voorhees | 340/409 |
| 3,351,934 | 11/1967 | Vietz | 340/409 |
| 3,500,394 | 3/1970 | Egesdal | 340/409 |
| 3,569,964 | 3/1971 | Mande | 340/409 |

FOREIGN PATENTS OR APPLICATIONS

| | | | |
|---|---|---|---|
| 46-11691 | 1/1966 | Japan | 340/214 |

*Primary Examiner*—Thomas B. Habecker

*Attorney, Agent, or Firm*—Haseltine, Lake & Waters

[57] ABSTRACT

Circuit conduction test arrangement for emergency alarm systems having a receiving panel for a group of several sections to be supervised and including common alarm means, and a plurality of relay panels installed in the respective sections; comprising in each relay panel a sensor and an alarm device connected in parallel, said relay panels including a test switch, a reset switch and an impedance network; the receiving panel including means responsive to the variation of the input impedance, having first and second responsive devices connected in a particular manner so as to provide safe operation for the circuit conduction tests. In the test operation, the common alarm means does not operate, and only the alarm device of the relaying panel operates which has its text switch activated.

10 Claims, 3 Drawing Figures

2
1
13b
4
12a
13
13a
Y
D4
Tr9
12
Tr8
13c
Tr10
Tr11
R1
C2
D1
D2
6
5
3
S3
S4a
S2
14
R
D01
7
S4
14a
R02
S4b
B
8
3
7
B
8

CIRCUIT CONDUCTION TEST ARRANGEMENT FOR EMERGENCY ALARM SYSTEMS

BACKGROUND OF THE INVENTION

In prior-art alarm systems, such as fire alarm apparatus or systems for use in apartment buildings of medium and high stories a panel for receiving and supervising informations from all floors or residences is installed in an administrator's room. Such receiving panel is also used to transmit test signals to respective residences. Such system is not advantageous in that to test the circuits it is necessary to operate manually the receiving panel, and that the construction of, the panel is complicated thus requiring troublesome maintenance and inspection.

Conventional alarm systems for use in apartment buildings of many stories generally comprise, alarm means for respective blocks, each usually consisting of one floor of the building, and alarm devices installed in respective residences. Consequently the system should meet following specifications.

a. In case of a fire hazard, the alarm device in the particular residence in which the fire hazard has occurred and the means of the particular block including the residence should be operated.
b. The operation test including a conduction test can be made for each residence independently of other residences.
c. During the operation test the alarm device of a specific residence alone should be operated, but the means of the block including the specific residence should not be operated.
d. The alarm device can be reset in each residence.
e. The alarm device for each residence that has been operated should be maintained in the operated condition until it is reset.
f. When a second and following alarm signal are transmitted the alarm device of a residence from which the second and following alarm signals have been transmitted should be operated.

In this manner, for the purpose of providing an effective alarm system suitable for use in an apartment building containing a number of residences it is necessary to construct and arrange a receiving panel, relay panels or repeaters and sensors to satisfy the requirements enumerated hereinabove.

SUMMARY OF THE INVENTION

It is an object of this invention to provide a new and improved circuit arrangement for emergency alarm systems capable of not only simplifying the construction of the receiving or central panel but also making it possible to perform circuit tests and resetting operations by relays installed in respective residences, that is on the alarm signal transmitting side.

Another object of this invention is to provide improved emergency alarm systems comprising a receiving panel installed at a central station, a sensor, a test switch, a reset switch and a repeater installed in each section or residence to be supervised and at least a pair of conductors interconnecting the receiving panel and the repeaters whereby an alarm signal and a test signal are transmitted from each repeater to the receiving panel for operating an alarm device in a different manner.

According to this invention there is provided emergency alarm systems of the class comprising a receiving panel provided for a group of a plurality of sections to be supervised and including common alarm means, source conductors extending from the receiving panel, a plurality of repeaters connected across the source conductors, the repeaters being installed in respective sections to be supervised, and each repeater comprising a sensor and an alarm device which are connected in parallel across the source conductors, characterized in that each repeater is provided with a test switch for performing a circuit conduction test, and a reset switch for terminating the test.

The test switch is connected to transfer the circuit connection of the repeater such that the value of the input impedance to the repeater is varied at the time of performing the test from the value at the time when the sensor transmits an alarm signal to the receiving panel. The receiving panel is provided with means responsive to the variation in the input impedance to the repeater for interrupting the energizing circuit for the common alarm means.

More particularly, the receiving panel is provided with a first relay for controlling the energization of the common alarm means, each repeater is provided with a second relay for operating the first relay and the alarm device in the repeater, and the test switch is connected to selectively interrupt the connection to the first relay.

The repeater further comprises a terminal diode connected in parallel opposition with the sensor and the test switch is connected such that it changes the polarity of the connection of the terminal diode and the sensor with respect ot the source conductors.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
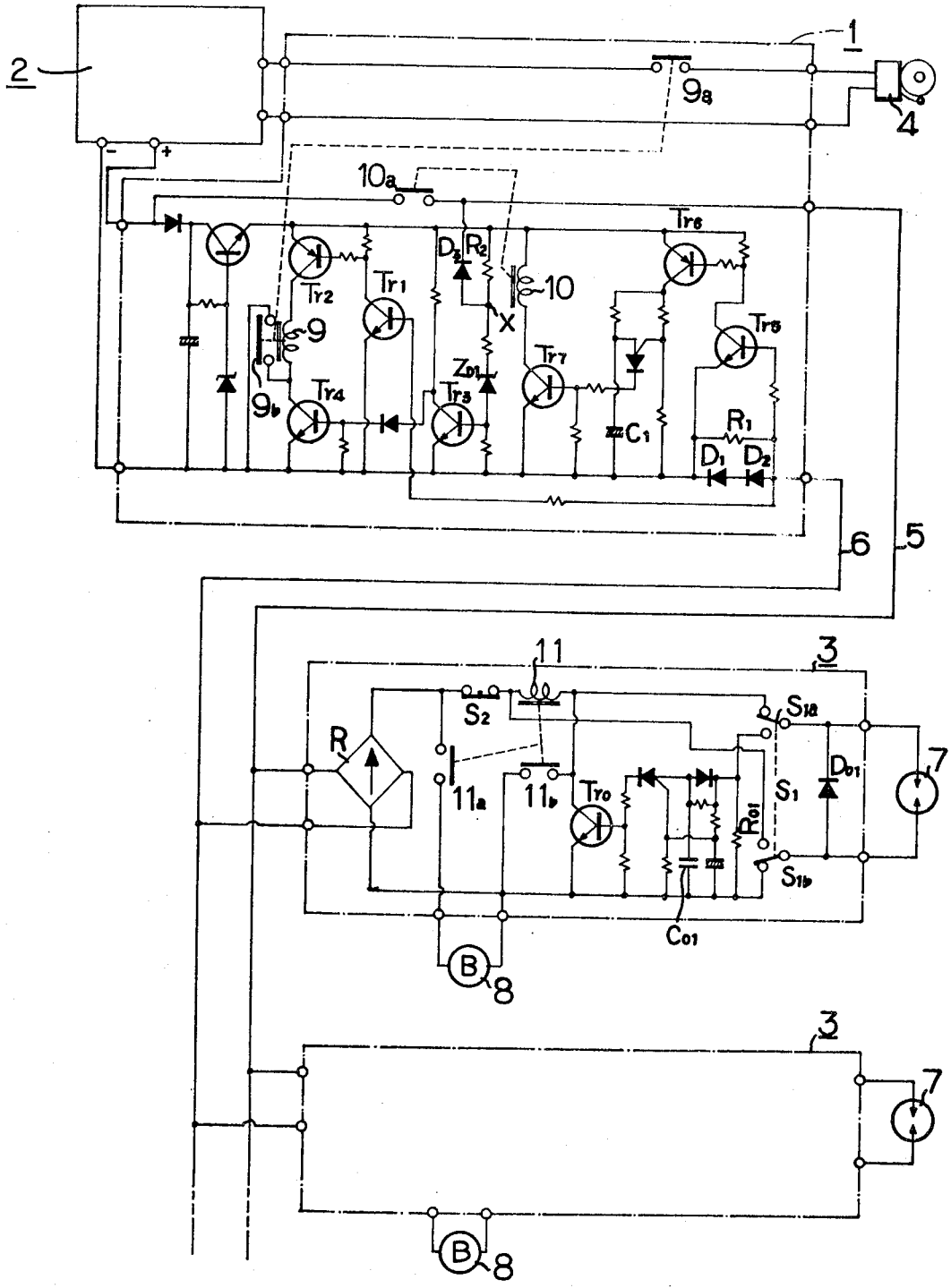
FIG. 1 shows a circuit diagram of a fire alarm system embodying this invention.
Figure 2:
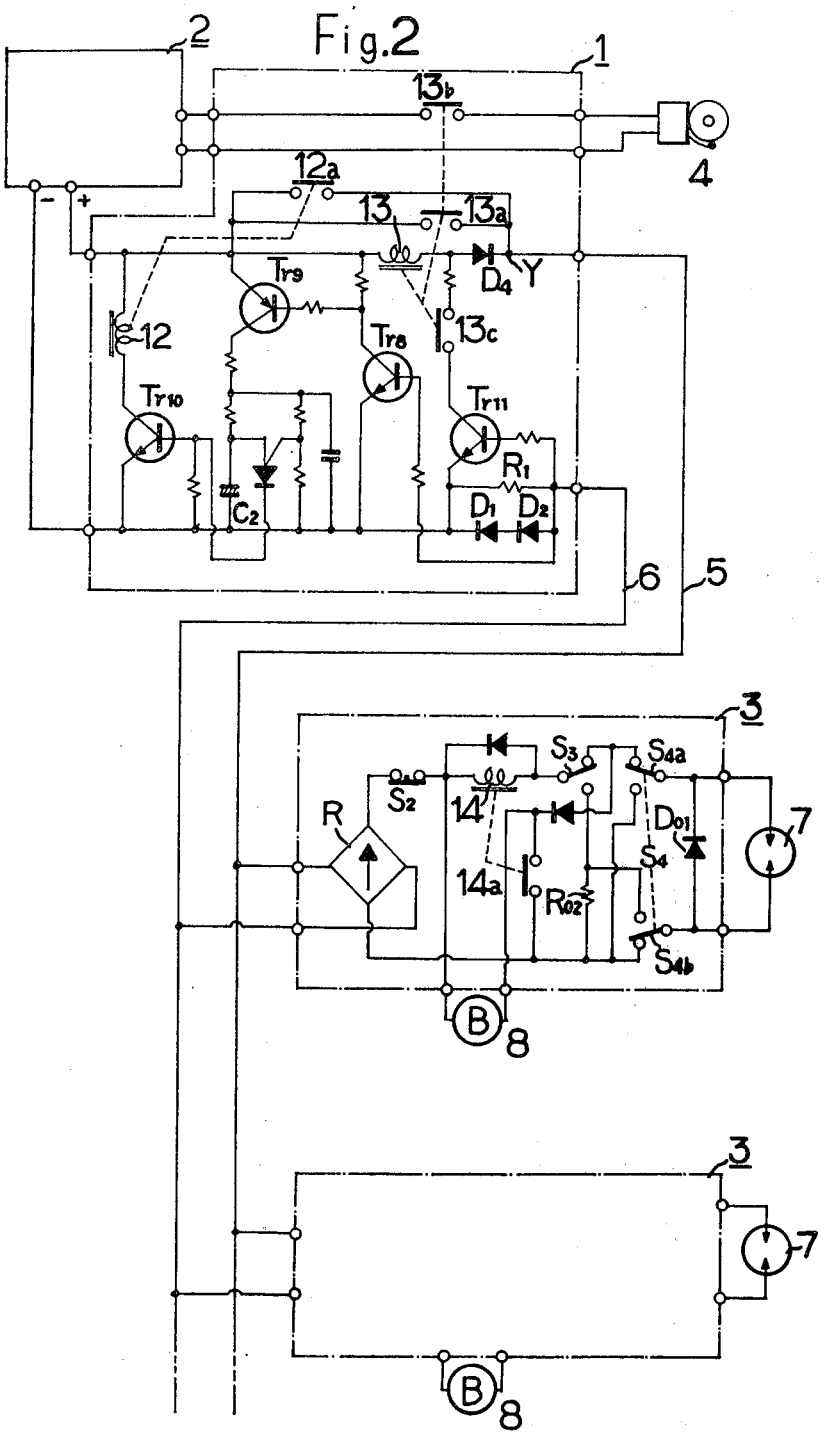
FIG. 2 shows a similar diagram of a modified embodiment of the invention.
Figure 3:
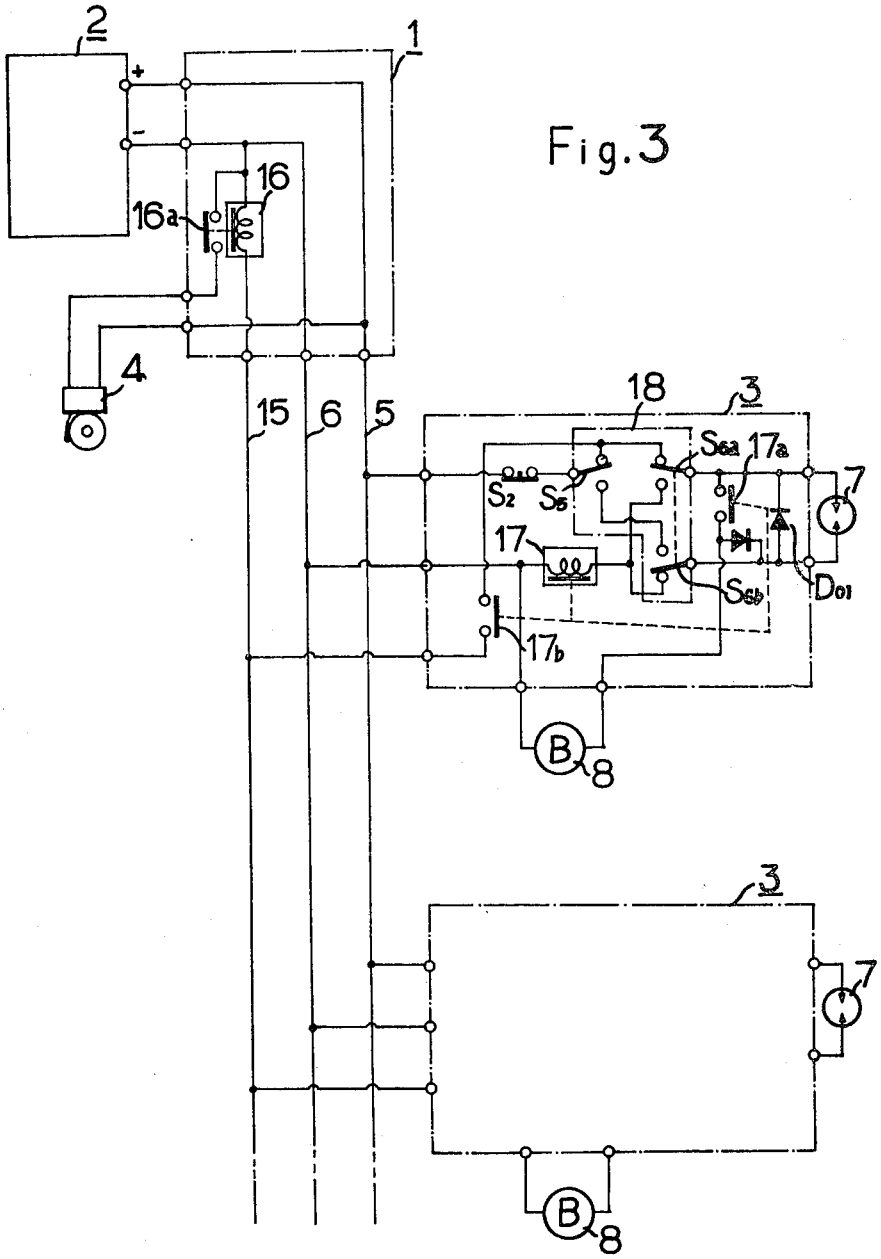
FIG. 3 is a diagram of a further modified embodiment of this invention.

Each fire alarm system shown in FIGS. 1, 2 and 3 is installed in one block of a residence building including a group of residences on one floor, and at least one, alarm means 4 such as an electric bell is provided on a receiving panel 1, in common for one block. Source conductors also used as signal conductors 5 and 6 extend from the receiving panel to respective residences in one block, and repeaters or relay panels 3 in respective residences are connected in parallel across conductors 5 and 6. Sensors 7 and alarm devices 8 are also connected in parallel across conductors 5 and 6. Any well known sensor that closes an electric circuit in response to a temperature rise, flame, smoke or the concentration of CO gas may be used as the sensor. An electric bell, buzzer, devices producing visible or audible alarms, or combinations thereof with a door locking device may be used as the alarm device 8.

The embodiment shown in FIG. 1 comprises a circuit for detecting a voltage drop, which includes a pair of diodes $D_1$ and $D_2$ connected in series with the source conductor 6 and a resistor $R_1$ connected in parallel with serially connected diodes $D_1$ and $D_2$, a relay 9 controlled by the voltage drop through transistors $Tr_1$ and $Tr_2$, a comparator including a constant voltage diode $ZD_1$ and transistors $Tr_3$ and $Tr_4$, the comparator controlling the relay 9 in connection with the transistor $Tr_2$ in accordance with the variation in the impedance across source conductors 5 and 6 and a relay 10 controlled with a predetermined time lag by the voltage drop through transistors $Tr_5$, $Tr_6$ and $Tr_7$.

A normally open contact 9*a* of relay 9 is connected in series with the common alarm means 4 whereas a normally open contact 10*a* of relay 10 is connected between the source conductor 5 and the positive pole of a source of supply 2. There is also provided the repeater or relay panel 3 for each residence comprising a terminal diode $D_{01}$ connected in parallel opposition with a sensor 7 which is arranged to respond to a fire hazard or the like, a test switch $S_1$ for reversing the polarity of the parallel connected diode $D_{01}$ and the sensor 7 with respect to the voltage across source conductors 5 and 6, a relay 11 connected in series with the sensor 7, and a delay control circuit including a transistor $TR_0$ and adapted to cause relay 11 to operate later than the relay 10 in the receiving panel 1. A normally open contact 11*a* of relay 11 is connected in series with the alarm device 8 whereas an other normally open contact 11*b* of relay 11 is connected to establish a self-holding circuit for relay 11. A manually operated normally closed reset switch $S_2$ is connected in series with relay 11 and a rectifier R. Although in the drawing the terminal diode $D_{01}$ is shown as included in the repeater 3 it will be clear that it can be incorporated with the sensor 7. As shown by dotted lines, it should be understood that the repeaters 3 are installed in respective residences.

The embodiment shown in FIG. 1 operates as follows. Under a normal condition, a voltage substantially equal to the source voltage is impressed across the sensor 7 through a circuit that can be traced from the positive pole of the source 2 via resistor $R_2$, diode $D_3$, source conductor 5, rectifier R, reset switch $S_2$, relay 11, a movable contact $S_{1a}$ of the test switch $S_1$, sensor 7, a movable contact $S_{1b}$ of the test switch $S_1$, rectifier R, source conductor 6, and diodes $D_2$ and $D_1$ to the negative pole of the source 2. Under these conditions, the impedance of the repeater 3 is high so that the potential at a point X in the receiving panel 1 has a value close to that of the source voltage. The constant voltage diode $ZD_1$ is selected such that it conducts under this potential value.

As a result, transistor $Tr_3$ is rendered conductive so that its collector-emitter voltage is substantially equal to zero. Under these conditions, no current flows through source conductor 6 so that no voltage drop will appear across serially connected diodes $D_1$ and $D_2$. As a consequence, both transistors $Tr_1$ and $Tr_5$ are maintained OFF. Since Transistor $Tr_1$ is OFF, transistor $Tr_2$ is also maintained OFF. However, as transistor $Tr_3$ is ON as described above, transistor $Tr_4$ is maintained OFF, thus deenergizing relay 9. In the same manner, as transistor $Tr_5$ is maintained OFF, relay 10 is also deenergized.

Upon occurrence of a fire hazard, the sensor 7 closes its contact whereby the impedance of the repeater 3 is reduced to a value substantially equal to that of the coil of relay 11. Accordingly, the potential of point X will be decreased to a fraction of the source voltage as determined by the ratio of the resistance of resistor $R_2$ to the resistance of the coil of relay 11.

Where the value of the resistor $r_2$ is selected such that the relay 11 will not be operated by this voltage and where the rating of the constant voltage diode $ZD_1$ is selected such that it will become nonconductive at this voltage, transistor $Tr_3$ will firstly be rendered OFF, thereby rendering conductive transistor $Tr_4$. The forward voltage drop across diodes $D_1$ and $D_2$ is impressed upon the base electrode of transistor $Tr_1$ as a bias voltage, thereby rendering ON transistors $Tr_1$ and $Tr_2$. Accordingly, relay 9 is energized to operate common alarm device 4 through its contact 9*a*. The relay 9 is self-held by the closure of its contact 9*b*. Transistor $Tr_5$ is rendered conductive concurrently with transistor $Tr_1$ thus rendering ON transistor $Tr_6$.

However, as the collector potential of transistor $Tr_6$ will not reach a value sufficient to render conductive transistor $Tr_7$ until a capacitor $C_1$ connected to the collector electrode of transistor $Tr_6$ is charged to a predetermined voltage, so that the transistor $Tr_7$ will be rendered conductive with a time delay determined by the value of capacitor $C_1$. In this manner, relay 10 is energized later than relay 9. As the relay 10 is energized its normally open contact 10*a* is closed to directly apply the source voltage upon conductor 5 whereby relay 11 is operated. Accordingly its contact 11*a* is closed to operate alarm device 8 in relay panel 3.

To test the circuit, the contacts $S_{1a}$ and $S_{1b}$ of the test switch $S_1$ are transferred to the lower and upper contacts respectively. Then the test current flows through a circuit that can be traced from the positive pole of the source 2 via resistor $R_2$, diode $D_3$, conductor 5, rectifier R, reset switch $S_2$, contact $S_{1b}$ of the test switch, terminal diode $D_{01}$, contact $S_{1a}$ of the test switch $S_1$, resistor $R_{01}$, rectifier R, conductor 6, diodes $D_2$ and $D_1$ and back to the negative pole of the source 2, thereby making the impedance of the repeater 3 substantially equal to the value of resistor $R_{01}$.

Accordingly, the potential at point X is changed to a value determined by the ratio of resistors $R_2$ and $R_{01}$. If the voltage rating of the constant voltage diode $ZD_1$ were selected such that it would still continue to conduct at this potential, the transistor $Tr_3$ would be maintained ON. The base electrode of transistor $Tr_0$ is connected to the movable contact $S_{1a}$ of the test switch $S_1$ through a delay circuit including a resistor $R_{01}$ so that the voltage (which is nearly equal to the voltage at point X) across resistor $R_{01}$ will be impressed upon the base electrode of the transistor $Tr_0$ after an interval determined by the value of capacitor $C_{01}$, thus turning ON transistor $Tr_0$. When transistor $Tr_0$ is turned ON, relay 11 is energized. If the value of capacitor $C_{01}$ is selected such that relay 11 is operated later than relay 10, as the relay 10 is operated with a time delay determined by the value of capacitor $C_1$ after the transfer of the test switch $S_1$ in the same manner as when an alarm signal is transmitted, the relay 11 will operate later than relay 10.

Thus, the source voltage impressed upon source conductors 5 and 6 by the operation of relay 10 is applied to the alarm device 8 when contact 11*a* of relay 11 is closed. At the same time the relay 11 is self-held by the closure of its normally open contact 11*b*. At this time, relay 9 will not be energized because transistor $Tr_3$ is ON and hence transistor $Tr_4$ is OFF. Accordingly, the contact 9*a* of relay 9 is not closed so that the common alarm means 4 will not be operated. To reset the relays, after the alarm signal has been transmitted or the test has been made, the reset switch $S_2$ is manually opened for deenergizing relay 11. Then the forward voltage drop across diode $D_1$ and $D_2$ disappears so that relays 9 and 10 are also deenergized.

The embodiment shown in FIG. 2 comprises the receiving panel 1 provided with diodes $D_1$ and $D_2$, transistors $Tr_8$ and $Tr_9$ which are rendered ON and OFF in accordance with the voltage drop across diodes $D_1$ and $D_2$, a transistor $Tr_{10}$ which is controlled by transistor $Tr_9$ through a delay circuit including a capacitor $C_2$, a relay 12 controlled by transistor $Tr_{10}$, a relay 13 having a lower operating voltage than relay 12, and a transistor $Tr_{11}$ adapated to establish a holding circuit for relay 13. A normally open contact 12*a* of relay 12 is arranged to directly connect conductor 5 to the positive pole of the source 2 and a normally open contact 13*a* of relay 13 is connected in parallel with contact 12*a*. A normally open contact 13*b* of relay 13 is connected in series with a common alarm means 4 whereas the normally open contact 13*a* of relay 13 is connected in series with the collector electrode of transistor $Tr_{11}$.

Each relay panel 3 comprises the sensor 7, the terminal diode $D_{01}$ connected in parallel opposition therewith, a manually operated test switch $S_4$ having movable contacts $S_{4a}$ and $S_{4b}$ for changing the polarity of the connection of parallel connected terminal diode $D_{01}$ and sensor 7 with respect to the output of a rectifier R energized by source conductors 5 and 6. A second switch $S_3$ is connected in series with the movable contact $S_{4a}$. The switch $S_3$ may be manually operated or interlocked with the cover (not shown) of the panel 3. The latter is also provided with a resistor $R_{02}$ which corresponds to resistor $R_{01}$ shown in FIG. 1 and acts as the test impedance and relay 14 connected in series with switch $S_3$ and having a normally open contact 14*a* connected in series with alarm device 8. The normally closed manual reset switch $S_2$ is connected in series with relay 14.

The circuit shown in FIG. 2 operates as follows. Under the normal condition, the source voltage is impressed across the senser 7 through a circuit extending across the positive and negative poles of the source 2, that extends through relay 13, diode $D_4$, conductor 5, rectifier R, relay 14, switches $S_3$ and $S_{4a}$, switch $S_{4b}$, rectifier R and conductor 6. Thus, a voltage substantially equal to the output voltage of the source 2 is impressed across the senser 7.

Upon occurrence of a fire hazard, the contact of sensor 7 is closed to energize relay 13. As this relay has a lower operating voltage (about one half of the source voltage) than relays 12 and 14 (having operating voltages nearly equal to the source voltage), relay 13 operates preferentially to close it contact 13*a* thus applying full output voltage of the source across conductors 5 and 6. When relay 13 is energized its contact 13*b* is also closed to operate the common alarm means 4. At the same time a contact 13*c* is also closed to close the collector circuit of transistor $Tr_{11}$. As has been described, since the potential drop across diodes $D_1$ and $D_2$ is impressed upon the base electrode of transistor $Tr_{11}$, this transistor becomes conductive to close the holding circuit for relay 13.

Concurrently with the conduction of transistor $Tr_{11}$, transistor $Tr_8$ is also rendered ON, which in turn turns ON transistor $Tr_9$, so that relay 12 is energized later than relay 13 when transistor $Tr_{10}$ is rendered ON later than transistor $Tr_9$ by an interval determined by the charging time of capacitor $C_2$. thus, contact 12*a* is closed in parallel with contact 13*a*.

When the source voltage is directly impressed across conductors 5 and 6 by the closure of th contact 13*a* of relay 13, the relay 14 in the panel 3 is energized to close its contact 14*a*, thus operating the alarming device 8.

To perform a test, the cover of the relay panel 3 is opened for transferring the switch $S_3$ to its lower contact. Then the impedance of the repeater 3 is comprised by resistor $R_{02}$ alone. Transistors $Tr_{11}$ and $Tr_8$ are rendered conductive by the voltage drop across diodes $D_1$ and $D_2$ caused by the current flowing therethrough under these conditions. If the value of resistor $R_{02}$ were selected such that relay 13 would not operate under these conditions, only relay 12 will be energized after a predetermined time, whereby the full output voltage of the source 2 will be impressed across conductors 5 and 6 by the closure of contact 12*a* of relay 12. When the test switch $S_4$ is transferred thereafter, relay 14 is energized through a circuit including conductor 5, rectifier R, reset switch $S_2$, relay 14, the lower contact of switch $S_3$, the movable contact $S_{4b}$ of test switch $S_4$, terminal diode $D_{01}$, the movable contact $S_{4a}$, rectifier R and conductor 6. Thus, relay 14 closes its contact 14*a* for operating the alarm device 8.

At this time, by the closure of the contact 12*a* of relay 12, the potential of point Y becomes equal to the source voltage, so that the relay 13 will not be energized, whereby the common alarm means 4 will not be operated. To reset the circuit, the reset switch $S_2$ is opened manually. Then relay 14 is deenergized and the voltage drop across diodes $D_1$ and $D_2$ disappears, thereby deenergizing relay 12. Under these circumstances, since the impedance of the repeater 3 is comprised by resistor $R_{02}$ alone, by selecting the value of this resistor such that relay 13 will not be operated, it is possible to deenergize all relays.

In still another embodiment of this invention shown in FIG. 3, the receiving panel 1 and the repeaters or relay panels 3 are interconnected by conductors 5 and 6 and an additional conductor 15 which is used as a signal conductor. In the receiver, a relay 16 is connected between conductors 6 and 15 so that relay 16 is energized when a signal current flow through the signal conductor 15, thus closing its contact 16*a* connected in series with the common alarm device 4.

As shown, each repeater 3 comprises the sensor 7, the terminal diode $D_{01}$ connected in parallel opposition with respect thereto, and a test switch 18 adapted to reverse the polarity of the connection between the source conductors 5 and 6, parallel connected terminal diode $D_{01}$ and sensor 7. Although in this embodiment the terminal diode $D_{01}$ is shown as disposed on the outside of the sensor 7 it will be clear that the terminal diode $D_{01}$ may be incorporated in the sensor 7. Three switches $S_5$, $S_{6a}$ and $S_{6b}$ of the test switch may be interlocked with each other. Alternatively, switch $S_5$ may be interlocked with the cover (not shown) of the panel 3 whereas the other switches, $S_{6a}$ and $S_{6b}$ installed in the casing of the panel may be interlocked with each other. Test switch 18 is also used to disconnect the panel 3 from signal conductor 15.

In the example shown, switches $S_{6a}$ and $S_{6b}$ are used for this purpose. The panel is also provided with a relay 17 which is connected to be energized when current flows through parallel connected terminal diode $D_{01}$ and sensor 7. Normally open contacts 17*a* and 17*b* of relay 17 are connected in series with alarm device 8 and signal conductor 15, respectively, thus constituting means for discriminating the alarm signal and the test signal. As before the manually operated normally closed reset switch $S_2$ is connected in series with switch $S_5$.

The embodiment shown in FIG. 3 operates as follows. When a fire hazard occurs in one residence, the contact of the sensor 7 installed in that residence is closed to pass the signal current through conductor 5, switches $S_2$, $S_5$ and $S_{6a}$, sensor 7, relay 17 and conductor 6. In response to this signal current the relay 17 operates to close its normally open contacts 17*a* and 17*b*.

Accordingly, the alarm device 8 of that residence is operated and relay 16, connected in series with the signal conductor 15, is energized to close its contact 16*a* thus operating the common alarm device 4. Energization of alarm device 8 and common alarm means 4 is continued until reset switch $S_2$ is opened to reset the sensor 7. If and alarm signal is also transimitted by another residence in response to the fire hazard, the alarm device 8 of that residence is also operated.

The conduction test of each residence is performed in the following manner. More particularly, the cover of the repeater installed in a particular residence is opened and switches $S_5$, $S_{6a}$ and $S_{6b}$ are transferred to the opposite contacts to establish a circuit extending through conductor 5, switches $S_2$, $S_5$ and $S_{6b}$, terminal diode $D_{01}$, switch $S_{6a}$, relay 17 and conductor 6. As a consequence, relay 17 is energized by the source 2 to close its normally open contacts 17*a* and 17*b*, thus operating the alarm device 8 of that residence.

However, the connection of conductor 5 to relay 16 through signal conductor 15 has been interrupted by switches $S_5$ and $S_{6a}$, and thus the common alarm means 4 for one block is not energized. The resetting of the circuit is performed by opening the reset switch $S_2$, thus deenergizing relay 17. In this manner, the conduction tests for respective residences can be performed by the operation of the test switch 16. When the test is over, reset switch $S_2$ is closed to restore the original condition.

It will thus be clear that the invention provides a novel alarm system in which the construction of the receiving panel is simplified, and the circuit conduction test can be performed at each residence without regard to other residences. Moreover, the novel alarm system satisfies all requirements described above. Accordingly, the invention is suitable for use in apartment houses having a number of stories.

What is claimed is:

1. A circuit conduction test arrangement for emergency alarm systems of the type having a receiving panel provided for a group of a plurality of sections to be supervised and including common alarm means, and a plurality of relay panels connected across a pair of conductors extending from said receiving panel, installed in the respective sections to be supervised; comprising in each of said relay panels a sensor and an alarm device connected in parallel across said conductors, said relay panels including a test switch, a reset switch and an impedance network for the circuit conduction test; said test switch being connected to vary the circuit connection of said relay panels such that, at the time of the test, said network is connected across said conductors to vary the input impedance of said relay panels from the value shown at the time when the respective said sensor is operated, and after that said network is disconnected to vary the input impedance to the same value as shown when said respective sensor is in operation; said receiving panel including means responsive to the variation of the input impedance, said responsive means having a first responsive device which operates while said respective sensor is in operation and which supplies power to said common alarm means, and a second responsive device which starts operating when said test switch is activated and said network is connected across said conductors; wherein said responsive devices are connected such that, when said second responsive device starts operating first, said first responsive device does not operate even if the input impedance achieves a value equal to that shown when said respective sensor is in operation after said network has been disconnected.

2. The test arrangement as defined in claim 1, wherein said relay panels further include first delay means which start operating after a first predetermined interval from the time when said test switch has been operated and said network has been connected across said conductors, thus to disconnect said network from said conductors and vary the input impedance to a value shown at the time when said respective sensor has been operated, and wherein said receiving panel further includes second delay means which allows said second responsive device to operate after a second predetermined interval from the time when said test switch has been operated and said network has been connected across said conductors, the first interval being longer than the second interval.

3. The test arrangement as defined in claim 1, wherein said first responsive device further includes a first relay for controlling the energization of said common alarm means, wherein each said relay panel further includes a second relay for operating said alarm device in each said relay panel, and said test switch is connected to selectively interrupt the connection to said first relay.

4. The test arrangement as defined in claim 3, wherein said first responsive device further includes a diode connected in series with said conductors, and means for operating said first relay in response to a voltage drop across said diode.

5. The test arrangement as defined in claim 4, wherein said receiving panel further includes a first impedance device connected in series with one of said conductors and having a value adapted to restrict the current flowing through said conductors, so as to prevent the operation of said second relay, a third relay for shorting said first impedance device, means for operating said third relay in response to a voltage drop across said diode and means for delaying the operation of said third relay, whereby when said sensor of one of the sections transmits an alarm signal to said receiving panel, said first relay is firstly operated to energize said common alarm means, and said second relay is then operated to energize said alarm device of the respective section.

6. The test arrangement as defined in claim 3, wherein said alarm device in each said relay panel is controlled by a transistor which is controlled by said test switch through a time delay circuit when said test switch is switched for performing the circuit conduction test.

7. The test arrangement as defined in claim 1, wherein each said relay panel further includes a terminal diode connected in parallel opposition with said respective sensor, and said test switch is connected such that it changes the polarity of the connection of said terminal diode and said sensor with respect to said conductors.

8. The test arrangement as defined in claim 1, wherein said receiving panel is provided with a source of supply for energizing said conductors, said first responsive device further includes a diode connected in series with said conductors, a third relay responsive to a voltage drop across said diode, for directly connecting said conductors to said source, a first relay connected in series with said conductors, said first relay having a normally open contact connected between said source and said common alarm means, and wherein each said relay panel is provided with a second relay energized by an alarm signal transmitted by said sensor, said first relay having a lower operating voltage than said second and said third relays so that when said sensor transmits the alarm signal to said receiving panel, said first relay operates first to energize said common alarm means, and then said second relay is operated to energize said alarm device.

9. The test arrangement as defined in claim 8, wherein said test switch includes first and second contacts for changing the polarity of the voltage impressed across said sensor, and a third switch connected between said second relay and said first contact for connecting a second impedance network in series with said second relay.

10. The test arrangement as defined in claim 8, wherein said third relay is connected to respond to the voltage drop across said diode through a time delay circuit.

* * * * *